US012357053B2

(12) United States Patent
Avelin et al.

(10) Patent No.: US 12,357,053 B2
(45) Date of Patent: Jul. 15, 2025

(54) SELF-CLEANING HELMET VISOR

(71) Applicant: Revolvision AB, Arbrå (SE)

(72) Inventors: Lars Olof Avelin, Arbrå (SE); Anton Avelin, Farsta (SE)

(73) Assignee: Revolvision AB, Arbrå (SE)

( * ) Notice: Subject to any disclaimer, the term of this patent is extended or adjusted under 35 U.S.C. 154(b) by 47 days.

(21) Appl. No.: 18/556,280

(22) PCT Filed: Apr. 13, 2022

(86) PCT No.: PCT/SE2022/050371
§ 371 (c)(1),
(2) Date: Oct. 19, 2023

(87) PCT Pub. No.: WO2022/225436
PCT Pub. Date: Oct. 27, 2022

(65) Prior Publication Data

US 2024/0206584 A1 Jun. 27, 2024

(30) Foreign Application Priority Data

Apr. 20, 2021 (SE) ..... 2150491-5

(51) Int. Cl.
*A42B 3/22* (2006.01)
*A42B 3/26* (2006.01)

(52) U.S. Cl.
CPC ..... *A42B 3/26* (2013.01); *A42B 3/222* (2013.01)

(58) Field of Classification Search
CPC .. A42B 3/26; A42B 3/222; A42B 3/14; A42B 3/042; A42B 3/16; A42B 3/225; A42B 3/30
See application file for complete search history.

(56) References Cited

U.S. PATENT DOCUMENTS 2,848,924 A * 8/1958 Charles ..... G02C 3/02 359/411
3,727,235 A * 4/1973 Fisher ..... A42B 3/222 2/10

(Continued)

FOREIGN PATENT DOCUMENTS

DE 3820352 A1 12/1989
DE 29621516 U1 2/1997

(Continued)

OTHER PUBLICATIONS

International Search Report and Written Opinion for International Application No. PCT/SE2022/050371, dated May 10, 2022, Patent-oc Registreringsverket, Stockholm, Sweden.

(Continued)

*Primary Examiner* — Khoa D Huynh
*Assistant Examiner* — Erick I Lopez
(74) *Attorney, Agent, or Firm* — Alston & Bird LLP

(57) ABSTRACT

Described herein is a self-cleaning visor (1) comprising: a support structure (2) having a see-through portion (2*a*); an endless transparent film (3); a film drive means (4); and at least one film cleaning means (5); and two fasteners (6). The support structure (2) is releasably attachable to an associated helmet (10) by the two fasteners (6) such that it is tiltable between a raised see-through position (A) and a lowered see-over position (B). The support structure (2) encloses the endless transparent film (3) except for at the see-through portion (2*a*). The support structure (2) comprises the film drive means (4) and the at least one film cleaning means (5). The support structure (2) supports the endless transparent film (3) to selectively be driven by the film drive means (4) in a continuous loop over the see-through portion (2*a*) and past the at least one film cleaning means (5).

13 Claims, 7 Drawing Sheets

(56) References Cited

U.S. PATENT DOCUMENTS

| | | | | | |
|---|---|---|---|---|---|
| 4,027,354 | A * | 6/1977 | Burpee | ..... | A42B 3/26 74/25 |
| 2019/0008228 | A1 * | 1/2019 | Ramey | ..... | A42B 1/24 |

FOREIGN PATENT DOCUMENTS

| | | | | | |
|---|---|---|---|---|---|
| FR | 2684524 | A1 | | 6/1993 | |
| JP | S52-092323 | U | | 7/1977 | |
| JP | S52-104420 | U | | 8/1977 | |
| JP | S53-155429 | U | | 12/1978 | |
| JP | S56-115433 | U | | 9/1981 | |
| JP | S59-76909 | A | | 5/1984 | |
| JP | H02-145806 | A | | 6/1990 | |
| JP | 2007-145150 | A | | 6/2007 | |
| KR | 10-1373711 | B1 | | 3/2014 | |
| KR | 101373711 | | * | 3/2014 | ..... A42B 3/26 |
| WO | WO-2009/148335 | A1 | | 12/2009 | |

OTHER PUBLICATIONS

European Search Report for Application No. 22792103.8, dated Feb. 24, 2025, 13 pages.

* cited by examiner

SELF-CLEANING HELMET VISOR

CROSS REFERENCE TO RELATED APPLICATIONS

This application is a National Stage Application, filed under 35 U.S.C. § 371, of International Application No. PCT/SE2022/050371, filed Apr. 13, 2022, which international application claims priority to and the benefit of Swedish Application No. 2150491-5, filed Apr. 20, 2021; the contents of both of which as are hereby incorporated by reference in their entireties.

TECHNICAL FIELD

The present disclosure relates generally to a self-cleaning visor, and in particular a self-cleaning visor that is releasably attachable to an associated helmet.

BACKGROUND

Harness racing is a form of horse racing in which the horses race at the specific gait of trotting. They usually pull a two-wheeled cart called a sulky, in which a driver wearing a protective helmet is seated.

Motocross, also known as "MX" is a form of high-speed dirt bike racing held on enclosed off-road circuits, often on rough, natural-terrain tracks covered with man-made jumps, berms, and various obstacles.

A common problem encountered by harness racing drivers and motocross motorcycle riders is that of impaired visibility, in particular in bad weather, due to soiling of protective eyewear or helmet visors by various projections.

This becomes especially cumbersome during the above types of racing, which involves several drivers or riders traveling at speed, in close proximity to and often close behind other contestants. For the harness racing driver, this is of course made even worse by the fact that the driver is situated immediately behind a horse, from which projections of mud and soiled water will be profusely present during wet track conditions.

When employing a helmet having a protective visor, cleaning the transparent part of the visor of the helmet, while the helmet is in use, will thus be a huge concern for the driver or rider, in order to maintain sufficient visibility to continue racing.

Most of the time, the driver or rider has no other solution than to wipe the visor, which usually forces the driver or rider to slow down and presents a serious risk of accidents as the focus of the driver or rider is diverted from the main task.

In order to address this problem and ensure that the driver or rider does not waste time and retain visual acuity, it has been suggested to apply one or more transparent plastic films to the visor, which the driver or rider can tear off successively as they become soiled, thus temporarily restoring visibility.

Tearing off such films, even in the case of an experienced driver or rider, presents an increased risk, due to the resulting loss of concentration and the fact that one hand must be release from other driving duties in order to effectuate such tearing.

Furthermore, it is generally not possible to apply more than a limited number of transparent films on the visor, as a to large aggregation of such films might cause distortion of the visual field of the driver or rider, which consequently limits the effectiveness of such films, in particular in longer races on wet and muddy racetracks.

Other attempts have been made to remedy the above-described drawbacks, in particular solutions where a transparent part of a visor can be cleaned, continuously or discontinuously, without manual intervention by the driver.

One such solution is described in FR 2684524 A1, which has a support part in the form of a ring where at least one portion, located opposite the eyes of a driver, has an opening or is transparent. An endless film made of a transparent material is arranged to be driven, continuously or in sequence, by motor means, making the film scroll past the open or transparent portion of the support part. At least one film cleaning means is arranged in contact with the external face of the film, with a view to cleaning its face when the film passes in front of this means.

Although the solution described in FR 2684524 A1 partially contribute in mitigating the prior-art problems there is still a need in the art for new and further improved solution thereto.

SUMMARY

An object of the present invention is to provide an improved self-cleaning visor, and in particular an improved self-cleaning visor that is releasably attachable to an associated helmet.

According to a first aspect this is provided through a self-cleaning visor that comprises: a support structure having a see-through portion; an endless transparent film; a film drive means; at least one film cleaning means; and two fasteners, where the support structure: is releasably attachable to an associated helmet by the two fasteners such that it is tiltable between a raised see-through position and a lowered see-over position; encloses the endless transparent film except for at the see-through portion; comprises the film drive means and the at least one film cleaning means; supports the endless transparent film to selectively be driven by the film drive means in a continuous loop over the see-through portion and past the at least one film cleaning means.

The above self-cleaning visor allows for reduced risk through ease of use and improved visibility, in particular when used while traveling on wet and/or muddy ground.

According to embodiments herein the two fasteners are elastically adaptable, such that their elasticity provide adaptability to different helmet sizes, and the fasteners further are opposingly attachable to respective sides of an associated helmet and each comprising a respective pivot adapted to be received and held by a complementary pivot receptor of the support structure. This enables the user a large choice of helmets for use with the self-cleaning visor and provide a reliable structure for enabling the self-cleaning visor being tiltable between the raised see-through position and the lowered see-over position.

In further embodiments the two elastically adaptable fasteners are attachable to an associated helmet by a harness comprising one or more straps arranged to cross the top of an associated helmet to restrict movement of the two elastically adaptable fasteners relative the top of an associated helmet. Attachment of the fasteners to an associated helmet by a harness of this kind provides for fastening thereof without mechanical and/or adhesive damage to the protective structure of the helmet and further facilitate flexibility and adaptability to different helmet sizes whilst ensuring proper positioning of the self-cleaning visor to an associated helmet of choice.

In yet some embodiments the respective pivot receptors of the support structure are arranged in cut-outs of corresponding shape to and arranged to, at least partially, accommodate the elastically adaptable fasteners. Hereby is afforded some protection of the fasteners and enabled a closer mounting of the self-cleaning visor in closer proximity to the periphery of the helmet, and thus a reduced total helmet/visor volume.

In still further embodiments the support structure, is arranged to be held in the see-through position by one or more magnetic elements arranged at a mechanical stop attachable to the back of an associated helmet and arranged to co-operate with corresponding magnetic elements arranged at a rear edge of the support structure. Hereby is enabled a reliable and secure, but still relatively easily overcome, positioning of the self-cleaning visor in the see-through use position.

In further embodiments the support structure, is arranged to be held in the see-over position by one or more magnetic elements arranged at a rear edge of the support structure and arranged to co-operate with corresponding magnetic elements at the mechanical stop. Hereby is enabled a reliable and secure, but still relatively easily overcome, positioning of the self-cleaning visor in the see-over rest position.

In at least some of these embodiments the mechanical stop is attachable to the back of an associated helmet by one or more straps of the harness. This provides for fastening thereof without mechanical and/or adhesive damage to the protective structure of the helmet, utilizing the same harness already employed for fastening the two elastically adaptable fasteners.

In yet some embodiments herein the film drive means is arranged to be activated to drive the film over the see-through portion and past the at least one film cleaning means upon being tilted into the see-through position and deactivated upon being tilted into the see-over position. This provides for reduced risk through ease of use, as positioning of the visor and activation/deactivation thereof are integrated in one and the same step.

In still further embodiments the film drive means is arranged to be selectively activatable to drive the film over the see-through portion and past the at least one film cleaning means, continuously or in sequence, when tilted into the see-through position. The ability to selectively drive the film continuously or in sequence provides for adapting the cleaning intensity to current requirements.

In some further embodiments a magnetic switch is arranged in the support structure and arranged to co-operate with corresponding magnetic elements at the mechanical stop, such that that the film drive means is activated to drive the film over the see-through portion when tilted into the see-through position and deactivated upon being tilted into the see-over position. Use of a magnetic switch provides for reliable switching whilst ensuring operability even in case of suffering projections of mud and soiled water.

In yet further embodiments the at least one film cleaning means comprises a brush or scraper arranged at a perimeter of the see-through portion of the support structure and above the endless transparent film. The brush or scraper removes the coarsest dirt from the transparent film and prevents sand and gravel from entering the support structure of the self-cleaning visor.

In some embodiments herein the brush or scraper is interchangeably attachable to the support structure. Hereby is provided for longevity of the cleaning abilities trough enabling replenishment with new brushes or scrapers as appropriate.

In additional embodiments the at least one film cleaning means comprises one or more cleaning compartments for interchangeably holding cleaning and/or drying equipment, said cleaning compartments arranged outside the see-through portion of the support structure and above the endless transparent film. Hereby is provided for longevity of the cleaning abilities trough enabling replenishment with new cleaning and/or drying equipment as appropriate as well as adaptation to cleaning requirements suited for prevailing environmental conditions.

In some such embodiments the at least one film cleaning means comprises at least two cleaning compartments. This further enhances the adaptability to cleaning requirements suited for prevailing environmental conditions as well as separation of different functionalities, such as wet-cleaning and drying.

Further envisaged herein is a protective helmet comprising a self-cleaning visor according to embodiments as described above.

BRIEF DESCRIPTION OF DRAWINGS

In the following, embodiments herein will be described in greater detail by way of example only with reference to attached drawings, in which.

DESCRIPTION OF EMBODIMENTS

In the following will be described some example embodiments of an improved self-cleaning visor 1, and in particular an improved self-cleaning visor 1 that is releasably attachable to an associated helmet 10.

The herein described self-cleaning visor 1 is based on the realization that there is a need for improving safety and usability of visors, especially visors for use by environmentally exposed drivers who needs to combine visors with a suitable protective helmet of their choice.

Figure 1:
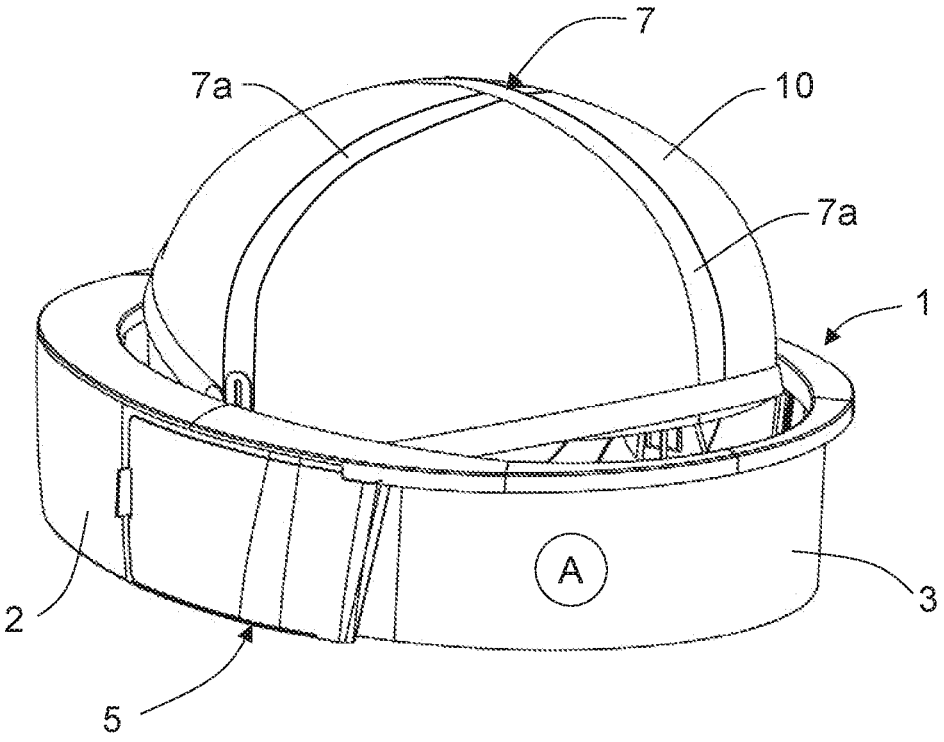
FIG. 1 illustrates schematically a self-cleaning visor attached to an associated helmet and placed in a raised see-through position.

Thus, according to a first aspect is proposed a self-cleaning visor 1, as illustrated in FIG. 1. The self-cleaning visor 1 comprises an annular support structure 2 having a see-through portion 2*a*, which as shown may be open but may alternatively be formed as a transparent portion of the support structure 2.

Figure 5:
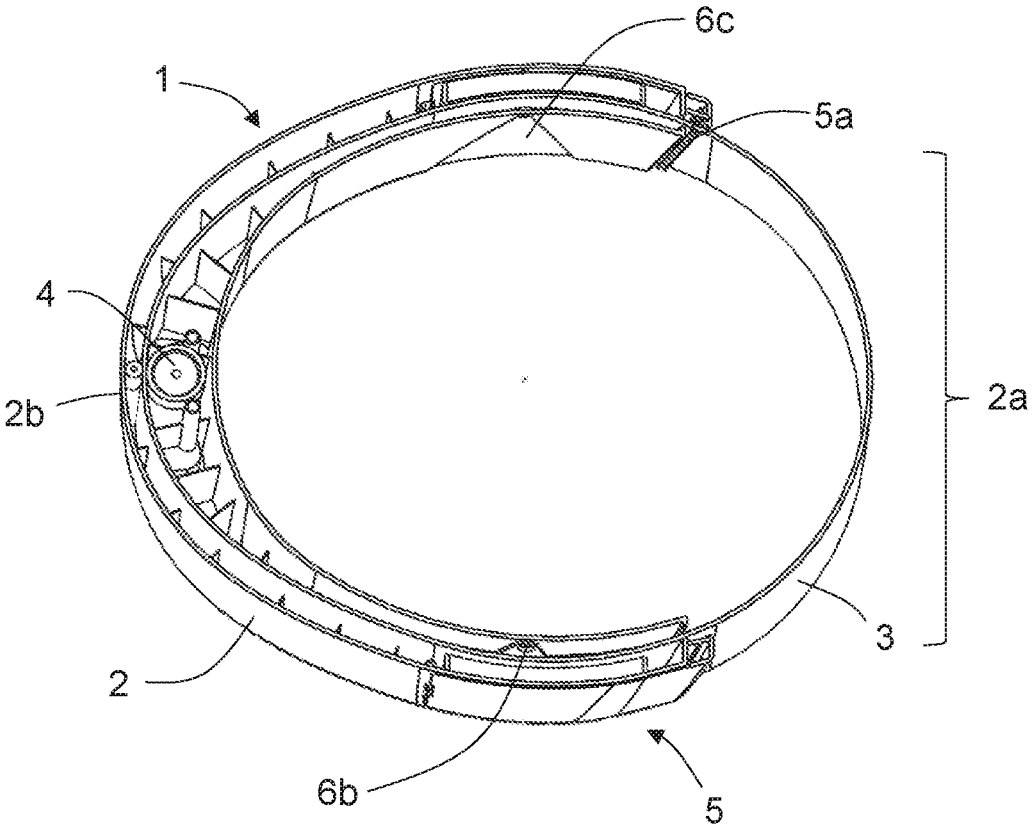
FIG. 5 illustrates schematically the interior layout of the self-cleaning visor of FIG. 1.

As illustrated in FIG. 5, the support structure 2 encloses an endless transparent film 3 except for at the see-through portion 2*a* and supports the endless transparent film 3 to selectively be driven by a film drive means 4 arranged in the support structure 2 in a continuous loop over the see-through portion 2*a* and past at least one film cleaning means 5 arranged at the support structure 2.

The film drive means 4 is suitably an electric motor capable of driving the endless transparent film 3. Drive of the endless transparent film 3 may be affected through friction, e.g. by the electric motor providing rotation to a rubberized wheel which is forced to press against the endless transparent film 3 and thus transfer movement thereto. Alternatively, translational movement may be imparted to the endless transparent film 3 by one or more toothed pinions, respectively engaging a series of notches or openings at a lateral edge of the endless transparent film 3 or yet alternatively by a pinion in cooperation with cogs provided at a lateral edge of the endless transparent film 3.

Power for the electric motor of the film drive means 4 may be provided from a battery pack (not shown), suitably attached to the self-cleaning visor 1 by appropriate wiring and adapted to be carried by a user of the self-cleaning visor 1.

The endless transparent film 3 may be guided within the support structure 2 by ribs or equivalent guide-elements. Support for the endless transparent film 3 past the see-through portion 2*a* may be provided by an annular top lid 11, shown in FIG. 7.

Figure 2:
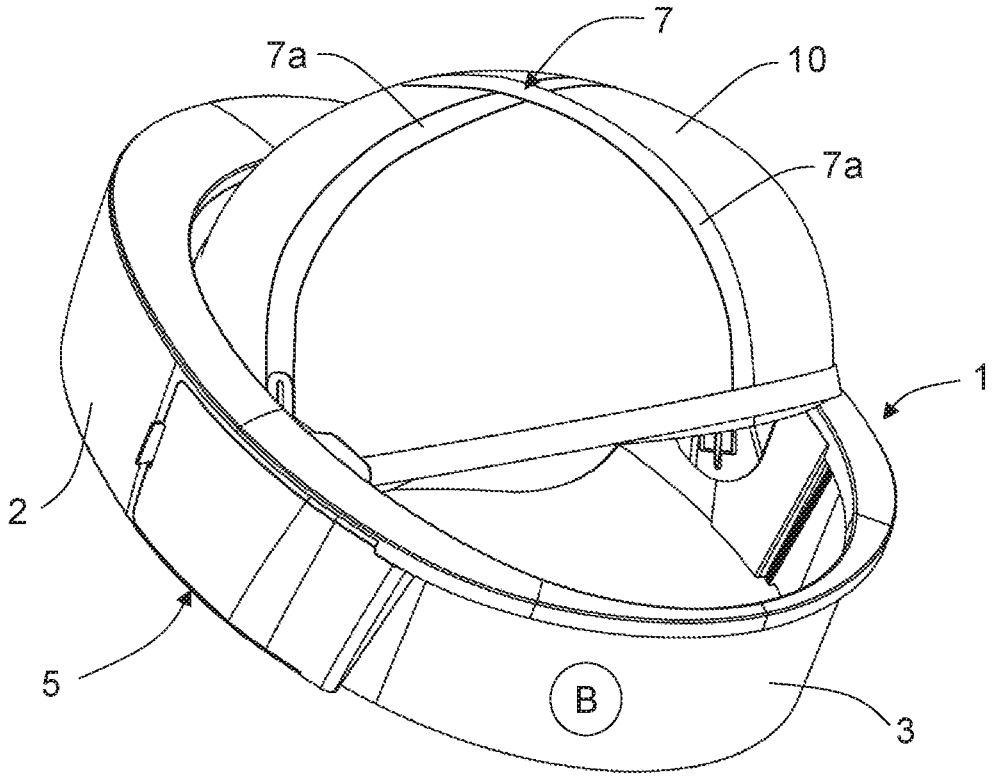
FIG. 2 illustrates schematically the visor of FIG. 1 in a lowered see-over position.

The support structure 2 is releasably attachable to an associated helmet 10 by two fasteners 6, such that it is tiltable between a raised see-through position A, as illustrated in FIG. 1, and a lowered see-over position B, as illustrated in FIG. 2. The raised see-through position A of FIG. 1 is a position in which a wearer of the helmet 10 would be able to see-through the endless transparent film 3 at the see-through portion 2*a* of the support structure 2 whereas the lowered see-over position B of FIG. 2 is a position in which a wearer of the helmet 10 would be enabled to see-over the endless transparent film 3.

Figure 3:
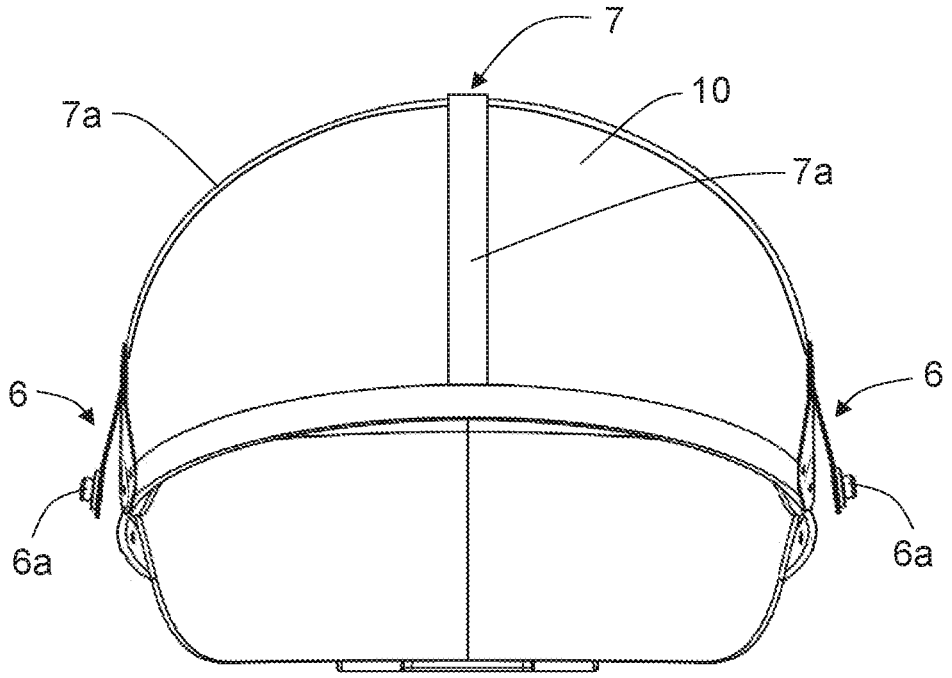
FIG. 3 illustrates schematically two elastically adaptable fasteners opposingly attached to respective sides of an associated helmet.

The support structure 2 is preferably releasably attachable to an associated helmet 10 by two elastically adaptable fasteners 6, as illustrated in FIG. 3. The elasticity of the two elastically adaptable fasteners 6 provide adaptability to different helmet 10 sizes, and may be provided by leaf spring or coil spring elements of the fasteners, e.g. as illustrated in FIG. 3, as leaf spring elements formed from elastic sheet-metal. The fasteners 6 are opposingly attachable to opposite sides of an associated helmet 10. Each fastener 6 comprises a respective pivot 6*a* adapted to be received and held by a complementary pivot receptor 6*b* of the support structure 2, thus providing for the self-cleaning visor 1 being reliably tiltable between the raised see-through position A and the lowered see-over position B.

The two elastically adaptable fasteners 6 are suitably attachable to an associated helmet 10 by a harness 7 comprising one or more straps 7*a* arranged to cross the top of an associated helmet 10 to restrict movement of the two elastically adaptable fasteners 6 relative the top of an associated helmet 10, i.e. to prevent the self-cleaning visor 1 from detaching from an associated helmet 10 and sliding down around a neck of an associated helmet 10 wearer.

Figure 6:
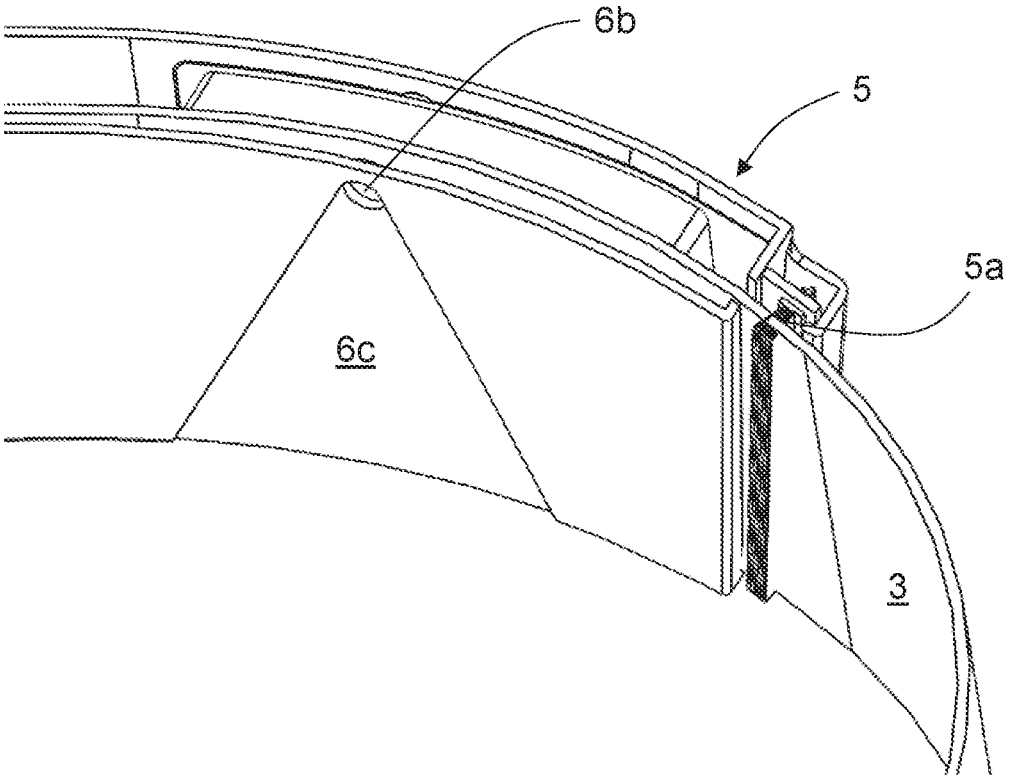
FIG. 6 illustrates schematically a cut-out in the self-cleaning visor arranged to, at least partially, accommodate the elastically adaptable fasteners of FIG. 3.

The respective pivot receptors 6*b* of the support structure 2 are, as illustrated in FIG. 6, suitably arranged in cut-outs 6*c* of corresponding shape to and arranged to at least partially accommodate the elastically adaptable fasteners 6. The cut-outs 6*c* are preferably sufficiently large to accommodate the fasteners 6 during pivot of the self-cleaning visor 1 between the raised see-through position A and the lowered see-over position B and vice-versa.

Figure 4:
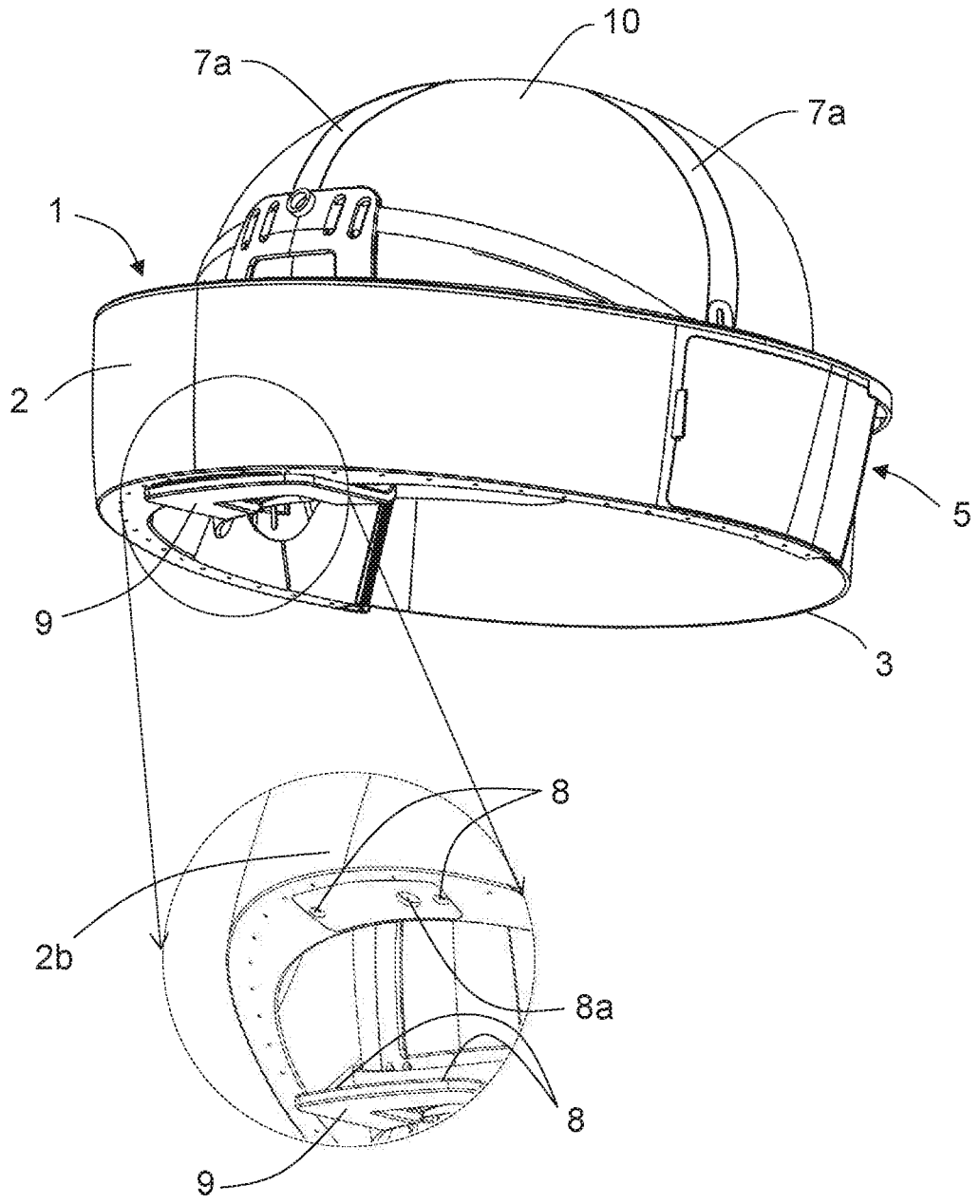
FIG. 4 illustrates schematically a mechanical stop attached to the back of an associated helmet.

To enable a reliable and secure, but still relatively easily overcome, positioning of the self-cleaning visor 1 in the see-through use position, the support structure 2 is arranged to be held in the see-through position A by one or more magnetic elements 8 arranged at a mechanical stop 9, as illustrated in FIG. 4. The mechanical stop 9 is attachable to the back of an associated helmet 10 and arranged to co-operate with corresponding magnetic elements 8 arranged at a rear edge 2*b* of the support structure 2, and also to limit movement of the see-through portion 2*a* of the self-cleaning visor 1 above a leading edge of an associated helmet 10.

Furthermore, to enable a reliable and secure, but still relatively easily overcome, positioning of the self-cleaning visor 1 in the see-over position B the support structure 2, is arranged to be held in the see-over position B by one or more magnetic elements 8 arranged at a rear edge 2*b* of the support structure 2 and arranged to co-operate with corresponding magnetic elements 8 at the mechanical stop 9. There is normally no need to limit movement of the see-through portion 2*a* of the self-cleaning visor 1 below the field of view of an associated helmet 10 wearer, as the self-cleaning visor in the lowered see-over position B naturally will come to rest against a neck of the associated helmet 10 wearer.

As it is important that the mechanical stop 9 can be attached to an associated helmet 10 without causing mechanical and/or adhesive damage to the protective structure thereof, the mechanical stop 9 is suitably attachable to the back of an associated helmet 10 by one or more straps 7*a* of the same harness 7 already employed for fastening the two elastically adaptable fasteners 6.

Positioning of the self-cleaning visor 1 and activation/deactivation of the film drive means 4 are integrated in one and the same step through the film drive means 4 being arranged to be activated to drive the film 3 over the see-through portion 2*a* and past the at least one film cleaning means 5 upon being tilted into the see-through position A and deactivated upon being tilted into the see-over position B.

In order to adapt the cleaning intensity to current requirements, the film drive means 4 may optionally be arranged to be selectively activatable to drive the film 3 over the see-through portion 2*a* and past the at least one film cleaning means 5, continuously or in sequence, when tilted into the see-through position A.

Activation/deactivation may be achieved through a magnetic switch 8*a* being arranged in the support structure 2 and arranged to co-operate with corresponding magnetic elements 8 at the mechanical stop 9. The magnetic switch 8*a* and the corresponding magnetic element 8 may be arranged such that that the film drive means 4 is activated to drive the film 3 over the see-through portion 2*a* when tilted into the see-through position A and deactivated upon being tilted into the see-over position B.

In order to remove coarse dirt from the transparent film 3 and prevent sand and gravel from entering the support structure 2 of the self-cleaning visor 1 the at least one film cleaning means 5 comprises a brush or scraper 5*a*, as illustrated in FIG. 6. The brush or scraper 5*a* is arranged at a perimeter of the see-through portion 2*a* of the support structure 2 and above the endless transparent film 3 and arranged to act thereupon.

To enable replenishment of worn brushes or scrapers 5*a* the brush or scraper 5*a* is interchangeably attachable to the support structure 2, e.g. via snap-in attachment means or similar.

In order to provide for longevity of the cleaning ability, the at least one film cleaning means 5 comprises one or more cleaning compartments 5*b* for interchangeably holding cleaning and/or drying equipment (not shown). The cleaning compartments 5*b* are arranged outside the see-through portion 2*a* of the support structure 2 and above the endless transparent film 3, such that the cleaning and/or drying equipment held therein can act upon the endless transparent film 3 as it is driven past the at least one film cleaning means 5. The cleaning compartments 5*b* may, as illustrated in FIG. 7, be sealable by snap-in lids 5*c*, which may comprise elements 5*d*, such as ribs, arranged to compress the cleaning and/or drying equipment against the endless transparent film 3, for improved cleaning/drying thereof.

Figure 7:
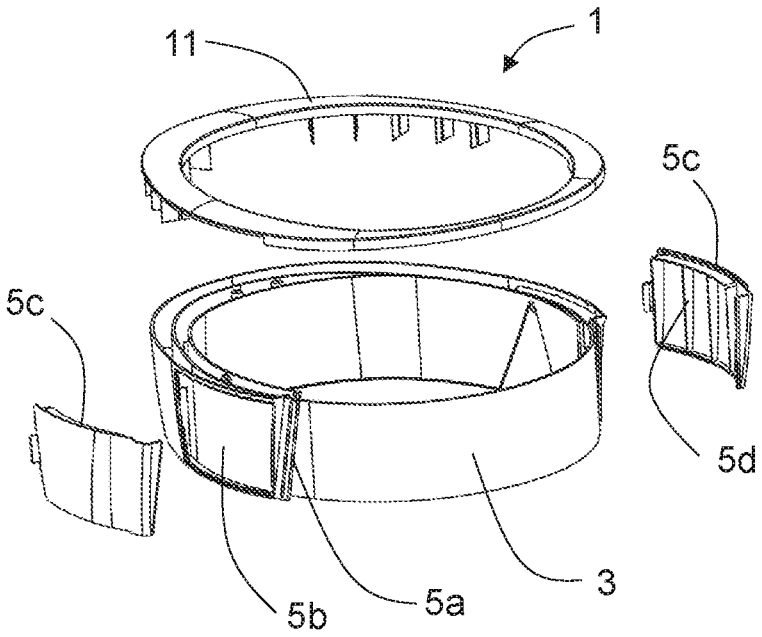
FIG. 7 illustrates schematically a partially exploded view of the self-cleaning visor of FIG. 1.

For enhanced adaptability to cleaning requirements and separation of different functionalities, such as wet-cleaning and drying, the at least one film cleaning means 5 comprises at least two cleaning compartments 5*b*, as illustrated in FIG. 7.

The cleaning and/or drying equipment held in the cleaning compartments 5*b* may e.g. comprise one or more removable sponges or similar, respective faces of which are arranged to be brought into contact with an external face of the endless transparent film 3. Such sponges or similar may e.g. be soaked in detergent products, soaked in water or may also be dry in order to remove any liquid remaining on the external face of the endless transparent film 3, after cleaning thereof.

Also envisaged herein is a protective helmet 10 that comprises a self-cleaning visor 1 as described in the foregoing. Such a protective helmet may alternatively upon being produced be provided with opposing fasteners at respective sides thereof, each comprising a respective pivot 6*a* adapted to be received and held by a complementary pivot receptor 6*b* of the support structure 2, as well as a mechanical stop 9 at the back thereof.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A self-cleaning visor (1) comprising:

a support structure (2) having a see-through portion (2*a*) and a pivot receptor (6*b*);

an endless transparent film (3);

a film drive means (4);

a harness (7);

at least one film cleaning means (5); and two elastic fasteners (6) each comprising a respective pivot point (6*a*) configured to be received and held by the complementary pivot receptor (6*b*) of the support structure (2);

wherein the support structure (2):

is configured to be releasably attachable to an associated helmet (10) via the two elastic fasteners (6), is tiltable between a raised see-through position (A) and a lowered see-over position (B);

encloses the endless transparent film (3) except for at the see-through portion (2*a*); and supports the endless transparent film (3) and guides the endless transparent film (3) within the support structure (2) by guide-elements, such that the endless transparent film (3) is selectively driven by the film drive means (4) in a continuous loop over the see-through portion (2*a*) and past the at least one film cleaning means (5); and wherein each of the two elastic fasteners are attachable to opposingly respective sides of the associated helmet (10) via the harness (7) comprising one or more straps (7*a*) configured to be positioned across a top of the associated helmet (10) to restrict movement of the two elastic fasteners (6) relative the top of the associated helmet (10).

2. The self-cleaning visor (1) according to claim 1, wherein the complementary pivot receptors (6*b*) of the support structure (2) are arranged in cut-outs (6*c*) of corresponding shape to and arranged to, at least partially, accommodate the elastic fasteners (6).

3. The self-cleaning visor (1) according to claim 2, wherein the support structure (2) is configured to be held in the raised see-through position (A) by one or more magnetic elements (8) positioned at a mechanical stop (9) attachable to the back of the associated helmet (10) and configured to co-operate with corresponding magnetic elements (8) arranged at a rear edge (2*b*) of the support structure (2).

4. The self-cleaning visor (1) according to claim 3, wherein the support structure (2) is configured to be held in the lowered see-over position (B) by one or more magnetic elements (8) positioned at a rear edge (2*b*) of the support structure (2) and configured to co-operate with corresponding magnetic elements (8) at the mechanical stop (9).

5. The self-cleaning visor (1) according to claim 3, wherein the mechanical stop (9) is attachable to the back of the associated helmet (10) by the one or more straps (7*a*) of the harness (7).

6. The self-cleaning visor (1) according to claim 3, wherein the film drive means (4) is configured to be:

activated to drive the endless transparent film (3) over the see-through portion (2*a*) and past the at least one film cleaning means (5) upon being tilted into the raised see-through position (A); and deactivated upon being tilted into the lowered see-over position (B) through a magnetic switch (8*a*) in the support structure (2) and positioned to co-operate with the corresponding magnetic elements (8) at the mechanical stop (9).

7. The self-cleaning visor (1) according to claim 3, wherein the film drive means (4) is configured to be selectively activatable to drive the endless transparent film (3) over the see-through portion (2*a*) and past the at least one film cleaning means (5), continuously or in sequence, when tilted into the raised see-through position (A) through a magnetic switch (8*a*) in the support structure (2) and positioned to co-operate with the corresponding magnetic elements (8) at the mechanical stop (9).

8. The self-cleaning visor (1) according to claim 3, wherein a magnetic switch (8*a*) is in the support structure (2) and positioned to co-operate with the corresponding magnetic elements (8) at the mechanical stop (9), such that the film drive means (4) is activated to drive the endless transparent film (3) over the see-through portion (2*a*) when tilted into the raised see-through position (A) and deactivated upon being tilted into the lowered see-over position (B).

9. The self-cleaning visor (1) according to claim 1, wherein the at least one film cleaning means (5) comprises a brush or scraper (5*a*) arranged at a perimeter of the see-through portion (2*a*) of the support structure (2) and above the endless transparent film (3).

10. The self-cleaning visor (1) according to claim 9, wherein the brush or scraper (5*a*) is interchangeably attachable to the support structure (2).

11. The self-cleaning visor (1) according to claim 9, wherein the at least one film cleaning means (5) comprises one or more cleaning compartments (5*b*) for interchangeably holding cleaning and/or drying equipment, said one or more cleaning compartments (5*b*) being positioned above the endless transparent film (3).

12. The self-cleaning visor (1) according to claim 1, wherein the at least one film cleaning means (5) comprises at least cleaning compartments (5*b*).

13. A protective helmet (10) comprising the self-cleaning visor (1) according to claim 1.

* * * * *